United States Patent [19]

Pezzoli

[11] Patent Number: 4,505,305

[45] Date of Patent: Mar. 19, 1985

[54] CARRYING GRIPPER FOR LOOMS

[75] Inventor: Nello Pezzoli, Leffe, Italy

[73] Assignee: Vamatex S.p.A., Villa di Serio, Italy

[21] Appl. No.: 377,258

[22] Filed: May 11, 1982

[30] Foreign Application Priority Data

May 15, 1981 [IT] Italy ..... 21736 A/81

[51] Int. Cl.[3] ..... D03D 47/22

[52] U.S. Cl. ..... 139/448

[58] Field of Search ..... 139/448

[56] References Cited

U.S. PATENT DOCUMENTS 2,960,117 11/1960 Shimwell ..... 139/448

2,960,118 11/1960 Ancet et al. ..... 139/448

4,071,055 1/1978 Haltmeier et al. ..... 139/448

*Primary Examiner*—Henry S. Jaudon

*Attorney, Agent, or Firm*—Young & Thompson

[57] ABSTRACT

A carrying gripper for shuttleless looms, of the type comprising an elongated base member with a profiled front end, in which the weft retention element is constituted by a metal pointed head pivoted on an axis parallel to said base member and arranged to engage said member under the action of a spring in order to clamp the weft yarn against it. The spring acts on an arm secured to the pointed head, on the side of that axis opposite to that on which the engagement between the head and the base member takes place, namely on the same side from which the weft yarn is fed.

1 Claim, 4 Drawing Figures

CARRYING GRIPPER FOR LOOMS

BACKGROUND OF THE INVENTION

This invention relates to a carrying gripper for shuttleless looms. It is a carrying gripper specially designed for fast looms for manufacturing fine articles.

It is known that, as the weaving speed increases in shuttleless looms, the gripping and retention of the weft yarns by the grippers which convey them through the shed present problems which are increasingly difficult to solve.

In particular, when the weft yarn to be inserted into the shed has to be gripped and cut, the very short time available for carrying out these two operations creates serious timing problems. In this respect, it is apparent that even minimum variations—which are perfectly normal also in a set machine—can lead in this particular stage of the operation either to tearing of the weft yarn or even to cutting thereof before it is properly inserted and retained in the gripper, with the result of the yarn being missed by the gripper.

It has been sought to remedy these drawbacks by delaying the cutting operation. In this way the weft yarn is sure to be properly inserted into the gripper even if cutting takes place before time, whereas any further delay of the cutting can only lead to sliding of the yarn between the gripper retention elements in the direction of its feeding to the fabric. However, with this arrangement, it is possible for the weft yarn—as a result of inertial or purely accidental stresses—to end up by sliding in the opposite direction, with the result of the yarn being missed and the loom stopping.

The stated problem is however efficiently solved by the gripper according to the present invention, in which the weft yarn retention element is conceived in such a way as to facilitate sliding of the yarn in the direction of its feeding to the fabric, while making it instead more difficult for the yarn to slide in the opposite direction.

SUMMARY OF THE INVENTION

This gripper is of the type consisting of an elongated base of plastic material, with its front end profiled, and is characterized in that it comprises a retention element constituted by a metal pointed head pivoted on an axis parallel to said base member and disposed longitudinally thereto, said metal pointed head being arranged to engage said member in order to clamp the weft yarn against it under the action of a spring, which acts through an arm disposed on the side of said axis opposite to the pointed head and on the same side of said axis from which the weft yarn is fed.

BRIEF DESCRIPTION OF THE DRAWINGS

The invention is described hereinafter in greater detail, by way of example, with reference to a preferred embodiment of the carrying gripper according to the invention, illustrated on the accompanying drawing in which.

DESCRIPTION OF THE PREFERRED EMBODIMENT

Figure 1:
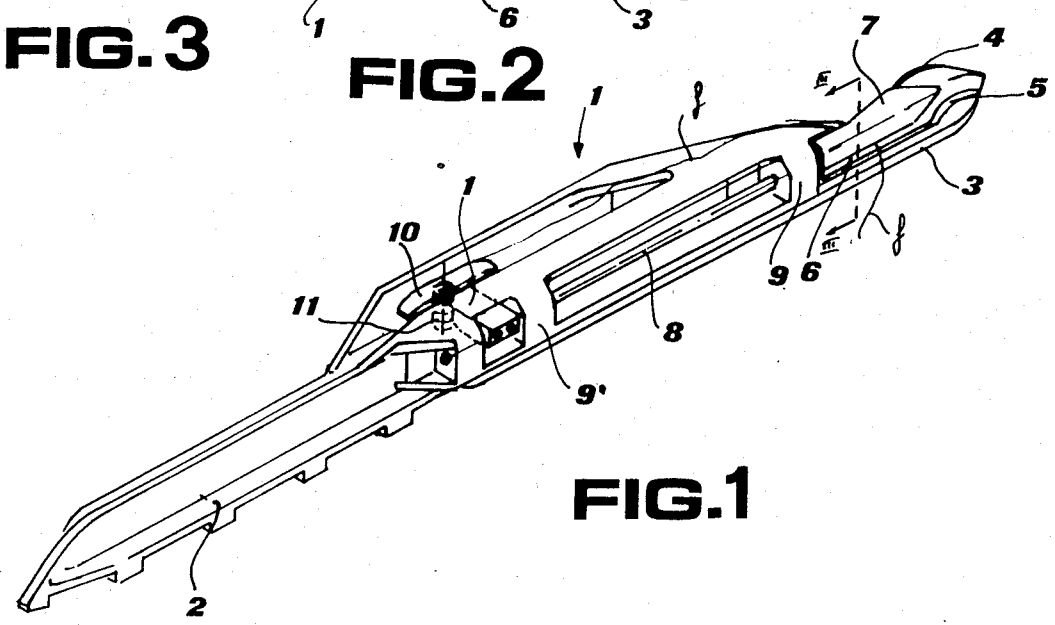
FIG. 1 is an outer overall perspective view of the gripper according to the invention.
Figure 2:
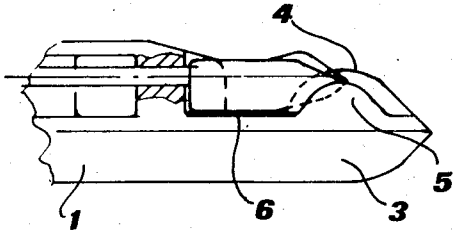
FIG. 2 is a side view of the front end of the gripper of FIG. 1 with its weft yarn retention element.

As can be seen from the drawing, the gripper according to the invention comprises a base member 1 of plastic material, by means of which the gripper is connected at its rear end 2 to the strap which controls its forward movement. The very elongated base member 1 has a profiled end 3 comprising yarn protection elements 4 and 5, and a flat seat 6 mounted on end 3 and with which the weft yarn retention element cooperates. This latter is constituted, according to the invention, by a metal pointed head 7 carried by a long metal pin 8 which is rotatably supported—parallel to the member 1 and disposed along its length—by two upwardly projecting blocks 9 and 9' of the member 1. The pin 8 extends slightly beyond the second supporting block 9' where a lateral arm 10 is fixed thereto, a spring 11 acting on one said on the lower part of said arm 10, while a gripper opening member 12, fixed to the loom, can act on the opposite side in the upper part of the same appendix.

As can be seen from the drawing, the pointed head 7 constituting the weft yarn retention element is mounted on its pin 8 so that the arm through which acts the spring 11 is located on the side of the pin opposite to that on which is located the pointed head 7. It can also be seen that said arm on which acts the spring 11 is furthermore arranged on the same side as that from which the weft yarn f is fed to the gripper.

Figure 3:
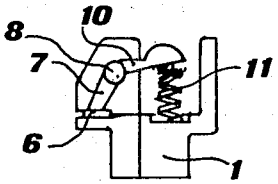
FIG. 3 is a cross-section on the line III—III of FIG. 1, through the gripper according to the invention, with the retention element in the retaining position, with blocks 9 and 9' removed.
Figure 4:
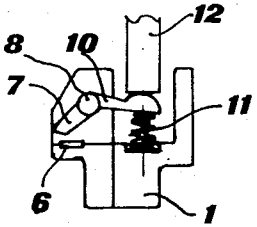
FIG. 4 is a cross-section similar to FIG. 3, but with the gripper retention element in the non-retaining position.

In operation, the yarn f is clamped by the pointed head 7 against the seat 6 of the member 1 when the gripper is in a retaining position, as shown in FIG. 3. In this condition, any action which tends to cause the yarn f to slide from the direction of its feeding towards the gripper and then beyond, towards the fabric being woven, is opposed by the action of the spring 11 and tends to raise the pointed head 7 from the seat 6. Sliding is thus facilitated in this case by the gripper characteristics. In contrast, any action which tends to cause the yarn f to slide towards the direction of its feeding, adds to the action of the spring 11, and tends to clamp even more the pointed head 7 against the seat, thereby making the retention of the yarn f in the gripper more steady. Sliding thus becomes in this case more difficult or even impossible.

It is to be noted that the gripper of the present invention is of the type that picks up a yarn on an insertion stroke from a stationary supply of yarn outside the sheds and releases the yarn to a coacting gripper within the sheds and returns empty. The metal pointed head is arranged on top of the member 1 and extends downwardly and laterally outwardly to the side opposite the side from which the weft yarn is fed. The head 7 extends to that opposite side downwardly a greater distance than it extends laterally outwardly when head 7 engages member 1 on the seat 6 of member 1.

The gripper which has been described and illustrated therefore completely attains the predetermined object, in that on the one hand it prevents or substantially reduces loss of yarn (which happens only if the yarn slides away from the gripper in the direction towards its feeding, an event which the gripper characteristics tend to prevent), and on the other hand it prevents or substantially reduces tearing of the yarn (which occurs if the yarn refuses to slide in the direction of the fabric being woven, an event which the gripper characteristics tend to favour).

The gripper according to the invention also attains a further important object. Because of the configuration and arrangement of the retention element, which undergoes small movements relative to the base member even if thick wefts are inserted, it is possible to eliminate the use of any appendices in the gripper for conveying the weft yarn and thereby the risk of warp yarns becoming hooked, so advantageously reducing the overall size and simplifying the design of the gripper.

It is to be understood that the above description and drawings, to which reference has been made heretofore, are given by way of example only and that there may be other practical embodiments of the carrying gripper falling within the scope of the present invention

I claim:

1. A carrying gripper for shuttleless looms, of the type that picks up a yarn on an insertion stroke from a stationary supply of yarn outside the sheds and releases the yarn within the sheds and returns empty, consisting of an elongated base member with its front end profiled, characterized in that it comprises a retention element constituted by a metal pointed head pivoted on an axis parallel to said member and disposed longitudinally thereto, said metal pointed head being arranged on top of said member and bing adapted to engage said member in order to clamp the weft yarn against it under the action of a spring, which acts through an arm disposed on the side of said axis opposite to the pointed head and on the same side of said axis from which the weft yarn is fed, said head extending downwardly and laterally outwardly to said opposite side, said head extending downwardly a greater distance than it extends laterally outwardly when said head engages said member, said metal pointed head being carried by a pin disposed along said axis and rotatably supported by two upwardly projecting blocks of the base member, said pin carrying at the end opposite to the pointed head said arm, on one side of which acts said spring and on the other side of which can act a member for opening the retention element in a non-retaining position.

* * * * *